US005080364A

United States Patent [19]

Seidman

[11] Patent Number: 5,080,364

[45] Date of Patent: * Jan. 14, 1992

[54] GAMING METHOD

[75] Inventor: Charles B. Seidman, Merion, Pa.

[73] Assignee: Take One Marketing Group, Inc., Merion, Pa.

[ * ] Notice: The portion of the term of this patent subsequent to Apr. 16, 2008 has been disclaimed.

[21] Appl. No.: 637,484

[22] Filed: Jan. 4, 1991

Related U.S. Application Data

[63] Continuation of Ser. No. 410,101, Sep. 20, 1989, Pat. No. 5,007,641.

[51] Int. Cl.[5] ..... A63B 71/00

[52] U.S. Cl. ..... 273/138 A; 273/139; 364/410

[58] Field of Search ..... 273/138 R, 138 A, 139, 273/269; 364/410, 412

[56] References Cited

U.S. PATENT DOCUMENTS

| | | | |
|---|---|---|---|
| 4,630,844 | 12/1986 | Troy et al. | 273/139 |
| 4,711,454 | 12/1987 | Small | 273/269 |
| 4,832,341 | 5/1989 | Muller et al. | 273/139 |
| 4,854,590 | 8/1989 | Jolliff et al. | 273/138 A |
| 4,906,826 | 3/1990 | Spencer | 273/138 A |

FOREIGN PATENT DOCUMENTS

| | | | |
|---|---|---|---|
| 2123702 | 2/1984 | United Kingdom | 273/138 A |

*Primary Examiner*—Benjamin Layno

*Attorney, Agent, or Firm*—Lerner, David, Littenberg, Krumholz & Mentlik

[57] ABSTRACT

A promotional game wherein prizes are automatically awarded upon presentation of tokens bearing machine readable codes. The tokens may be identical to tokens bearing a common code, and the prizes may be awarded at random to patrons who present an appropriate token bearing this common code. Desirably, the prizes are awarded substantially immediately upon presentation of the tokens. The tokens may be product identification code symbols on packages of goods.

21 Claims, 2 Drawing Sheets

GAMING METHOD

This is a continuation of U.S. Pat. No. 5,007,64 application Ser. No. 07/410,101, filed Sept. 20, 1989.

FIELD OF THE INVENTION

The present invention relates to games, and particularly relates to games wherein prizes are awarded.

BACKGROUND OF THE INVENTION

Various establishments seek to attract patrons by offering something of value to those prospective patrons who enter the establishment or who purchase particular products. Such offers may be in the nature of a promised free gift to each patron, to be awarded when the patron enters the establishment. In these games, every person entering the establishment, or every person entering the establishment and meeting certain predetermined qualifications may receive the same gift. Likewise, incentive schemes to induce purchase of particular products or services ordinarily award the same gift to each purchaser. Other, similar schemes utilize an element of random chance. For example, in a so called "match and win" promotion, tokens bearing differing indicia, such as different pictures or combinations of alphanumeric characters may be distributed to prospective patrons. Different prizes are associated with some or all of the different indicia, and the prize associated with each indicia is posted or otherwise made known within the establishment. Thus, the prospective patron must enter the establishment to determine what, if any, prize he has won. Often, the various indicia include one or more very rare indicia applied to only a few of the tokens and associated with prizes of significant value and other, common indicia applied to the remaining tokens and associated with prizes of minimal value or with no prize at all. As only a few patrons will win prizes of significant value, the total value of prizes distributed in the scheme will not pose a prohibitive cost to the sponsor of the scheme. Nonetheless, the possibility, albeit remote, of winning a prize of significant value provides a powerful incentive to prospective patrons. Although games of this nature can be a useful marketing tool, they suffer from significant drawbacks. Manufacture and distribution of the tokens is costly. Security measures must be employed to prevent persons involved in distribution of the tokens from calling out those tokens bearing the rare indicia associated with valuable prizes and diverting those tokens to their own use. The security measures add to the cost of conducting the game. Moreover, these games provide minimal entertainment to the patron. After the patron has determined what prize he has won, the game is over insofar as he is concerned. The game thus has no value whatever in inducing the customer to remain in the establishment. Games of this nature normally are not integrated with any mechanism or compiling a list of patrons entering the establishment for use in future promotional efforts.

Other promotional schemes have been conducted using identical tokens, such as identical coupons printed in newspaper advertisements and coupons incorporated as part of packages for goods. Ordinarily, all of the tokens or coupons used in such a scheme are identical and entitle the person holding the coupon to the same value. For example, coupons can be printed in a newspaper offering a discount on a specific item of merchandise in a store. Also, packaged goods often carry coupons which either entitle the customer to a discount on subsequent purchase of the goods or which can be redeemed for unrelated merchandise. Many of these promotions involve redemption by mail. In such promotions, the coupon or token may be imprinted with a machine readable code such as a bar code. Where packaged goods are involved, the bar code may be the universal product code or "UPC" code used to identify the goods for inventory and sale purposes. Promotions of this nature generally do not provide any element of randomness. Thus, each consumer may acquire the same item of relatively small value by presenting or redeeming the coupon or token. There is no chance for the consumer to acquire a highly valuable prize.

Thus, despite the considerable effort that has been applied heretofore towards improvements in promotional schemes, there are still needs for further improvement.

The present invention addresses these needs.

SUMMARY OF THE INVENTION

One aspect of the present invention provides a gaming method including the steps of automatically reading codes on tokens presented by patrons at a redemption location within an establishment. Preferably, the method includes the step of automatically comparing the code read from each presented token with one or more predetermined winning codes and awarding prizes to at least some of the patrons who present tokens bearing a code matching a predetermined winning code. Desirably, the tokens include a multiplicity of tokens all bearing a common machine readable code which matches a winning code and the step of awarding prizes includes the step of randomly assigning prizes to patrons who present tokens bearing this common code. The tokens may include several classes of tokens, the tokens of each class each bearing the same common code, but the common codes differing among the different classes. There may be several winning codes matching the different common codes. Preferably, the random assignment of a prize to a patron presenting a .token bearing the common code is performed upon presentation of the token by the patron.

In a game of this nature, the prizes may vary substantially in value, so that no prize or only a prize of small value is awarded to most of the patrons who present a token With the common code but a prize of substantial value is awarded to a few patrons. Because the game presents the possibility of winning a prize of very substantial value, it gives the prospective patron a substantial incentive to enter the establishment and play the game. However, because the high-value prizes are not associated prior to presentation with particular high-value tokens, there is no need for special security measures to protect any special or unique tokens. It is impossible for an insider to gain any particular advantage by selecting some particular tokens. The tokens may be distributed with goods sold at retail, as by distributing packages of goods bearing the tokens through normal retail sale distribution channels. Most desirably, the token may be a part of the goods package bearing a machine readable product identification code. Most preferably, the tokens are universal product code symbols. As such product identification code symbols are present on goods packages for other purposes, there is no need to distribute any special tokens and hence all of the costs associated with manufacturing and distributing special tokens are eliminated. Moreover, the game may be conveniently associated with purchase of particular products. Where a universal product code symbol or other portion of a package for particular goods constitutes the token, the prospective patron of the establishment must purchase the goods in order to play the game. Where the redemption location is at an establishment other than the location where the goods are sold, the patron must visit the other establishment as well. This provides a "tie-in" in that the game promotes both the goods and the other establishment.

Alternatively, the redemption location may be in the establishment where the goods are sold, and the steps of automatically reading the code and awarding prizes may be performed concomitantly with sale of the goods. Where the token is a part of a package, such as a universal product code symbol, the step of automatically reading the code may be performed by the same automatic data processing equipment as used in the sale transaction. This provides the patron "instant" winning opportunity immediately upon purchase of the goods. The method may also include the further step of testing each patron who presents a token with the correct code for additional qualifications and awarding prizes only to those patrons who meet such additional qualifications. Such additional qualifications typically are not associated with the tokens, but rather with the patron. Preferably, the additional qualifications include presentation of data identifying the patron, such as the patron's name and address, and the method may further include the step of recording the identities of qualifying patrons. These operations desirably are performed using the same automatic data processing apparatus at the redemption location used to automatically read the code on the tokens. This permits the establishment to compile a list of patrons for future marketing efforts. The method may also include the step of automatically recording the time of presentation of a token by the individual patron in association with the patron's identity, and the additional qualifications may include time since last played by the patron. Alternatively or additionally, the time record of presentation by individual patrons may be used to determine the time span during which the patron has remained at the establishment, so that patrons may be awarded either progressively larger prizes, greater prize winning opportunities or other things of value for remaining within the establishment during a prolonged period. The step of distributing tokens may include the step of distributing tokens bearing both the machine readable code for comparison with the winning code and identifying indicia unique to the individual patron. These unique tokens may be distributed either in place of or in addition to the uniform tokens, as by mailing the unique tokens to individual patrons or giving the unique tokens to the individual patrons upon presentation of one of the uniform tokens. The identifying indicia may be automatically read to establish patron identity as discussed above upon presentation of the token.

These and other objects, features and advantages of the present invention will be more readily apparent from the detailed description of the preferred embodiment set forth below, taken in conjunction with the accompanying drawings.

DETAILED DESCRIPTION

Figure 1:
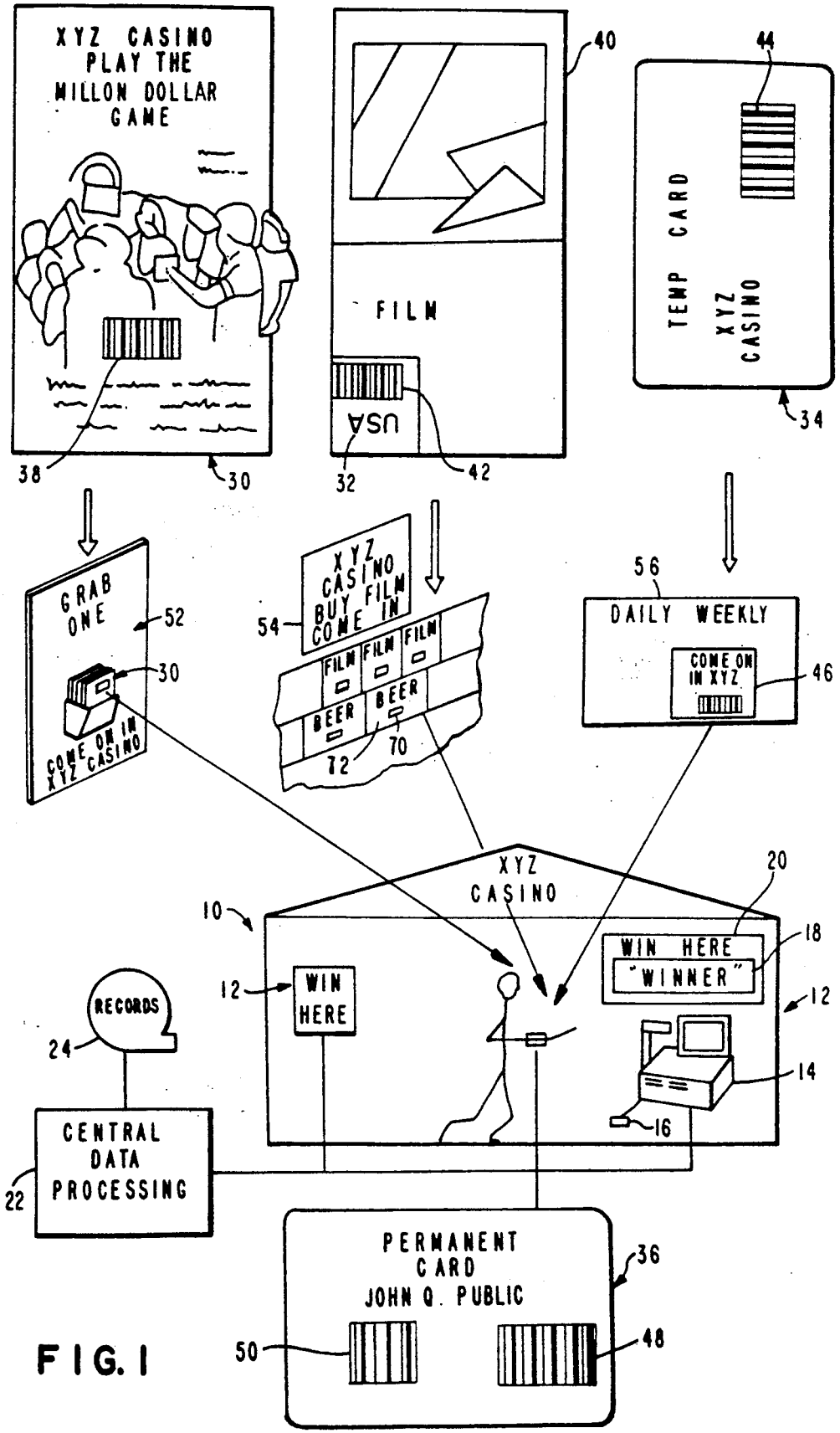
FIG. 1 is a diagrammatic view showing certain elements used in a gaming method according to one embodiment of the invention.

A game in accordance with one embodiment of the present invention is ranged to attract patrons to an establishment 10, which in this embodiment is a legal gambling casino. At several redemption locations 12 within the casino, electronic data processing apparatus 14 incorporating a standard data entry terminal with conventional input and output devices including an optical bar code reader 16. The data entry terminal may be a standard terminal of the type used as a retail point of sale terminal such as the terminal sold under the designation 1181 Twinax Point of Sale Terminal by the International Business Machines corporation of Armonk, N.Y., U.S.A. and the bar code reader and other input and output displays may be standard devices of the type used with this terminal. The terminal 14 is linked to a selectively operable illuminated sign or other selectively operable display device arranged to display a conspicuous message which can be seen from far away. The selectively operable message includes words such as "winner", "jackpot" or the like indicating that someone has won a high valued prize. Other, continuously displayed signs 20 indicate the presence of a redemption location. Each of the other redemption locations 12 is provided with similar data processing equipment and signs (not shown) The data processing equipment 14 at each redemption location 12 is connected via standard data linkages to a central digital computer 22 of standard design, which in turn is linked to a standard storage device 24 such as a disk or tape drive.

The game is played using several different types of tokens, of which four types 30, 32,, 34 and 36 are depicted in FIG. 1. Token 30 of the first type are specially printed cards being the name of the establishment and also bearing a machine readable bar code 38. Tokens of the second type 32 are portions of packages 40 of a product sold at retail, in this case film. Each token 32 contains a machine readable bar code 42 which in this case is simply the universal product code associated with the film sold in package 40. As will be appreciated, products sold at retail, as in grocery and drug stores, typically carry a universal product code in machine readable bar code form, this code being used in retail transactions for product identification and charging purposes The tokens 34 are coupons bearing machine readable codes 44, these coupons being printed as portions of newspaper advertisements 46. Tokens 36 are permanent or semi-permanent card-like items, similar in structure to a credit or card from a past or the like Tokens 36 bear machine readable codes 48 and further machine readable identifying indicia 50, which may also be in the form of a bar code, the machine readable identifying indicia 50 identifying a particular patron.

The machine readable gaming codes 38 on all of tokens 30 of the first type may be the same. Likewise, all of tokens 32 may carry the same machine readable gaming code 42, all tokens 34 may carry the same gaming code 44 and all tokens 36 of the fourth class may carry the same machine readable gaming code 48. Codes 38, 42, 44 and 48 may be the same as one another but desirably each is a different code. Tokens 38 are distributed to prospective patrons of the establishment 10 by giveaway displays 53 mounted in various locations within the geographical target market of the establishment, as at retail stores and the like. The displays 52 bear indicia publicizing the contest and inviting the prospective patron to take a token 30. Tokens 32 are distributed simply by ordinary retail distribution of the packages 40 bearing the tokens 32. Inasmuch as the token 32 is an ordinary part of the package which is present at all times, the distributor of the packages 40 is not required to alter or modify the package in any way so as to make it suitable for the game.

Packages 40 bearing tokens 32 of the second type may be distributed in the ordinary fashion via retail stores. Prospective patrons may be advised of the game, and advised that the universal product code section of the packages 40 can be used as game tokens by any suitable advertising method, as by television, radio or magazine advertisements and also by point of purchase signs 54 if desired. Coupons or tokens 34 of the third type are distributed by ordinary distribution of newspaper 56. Tokens 36 of the fourth type are distributed within the establishment or casino 10, as further described hereinbelow.

Figure 2:
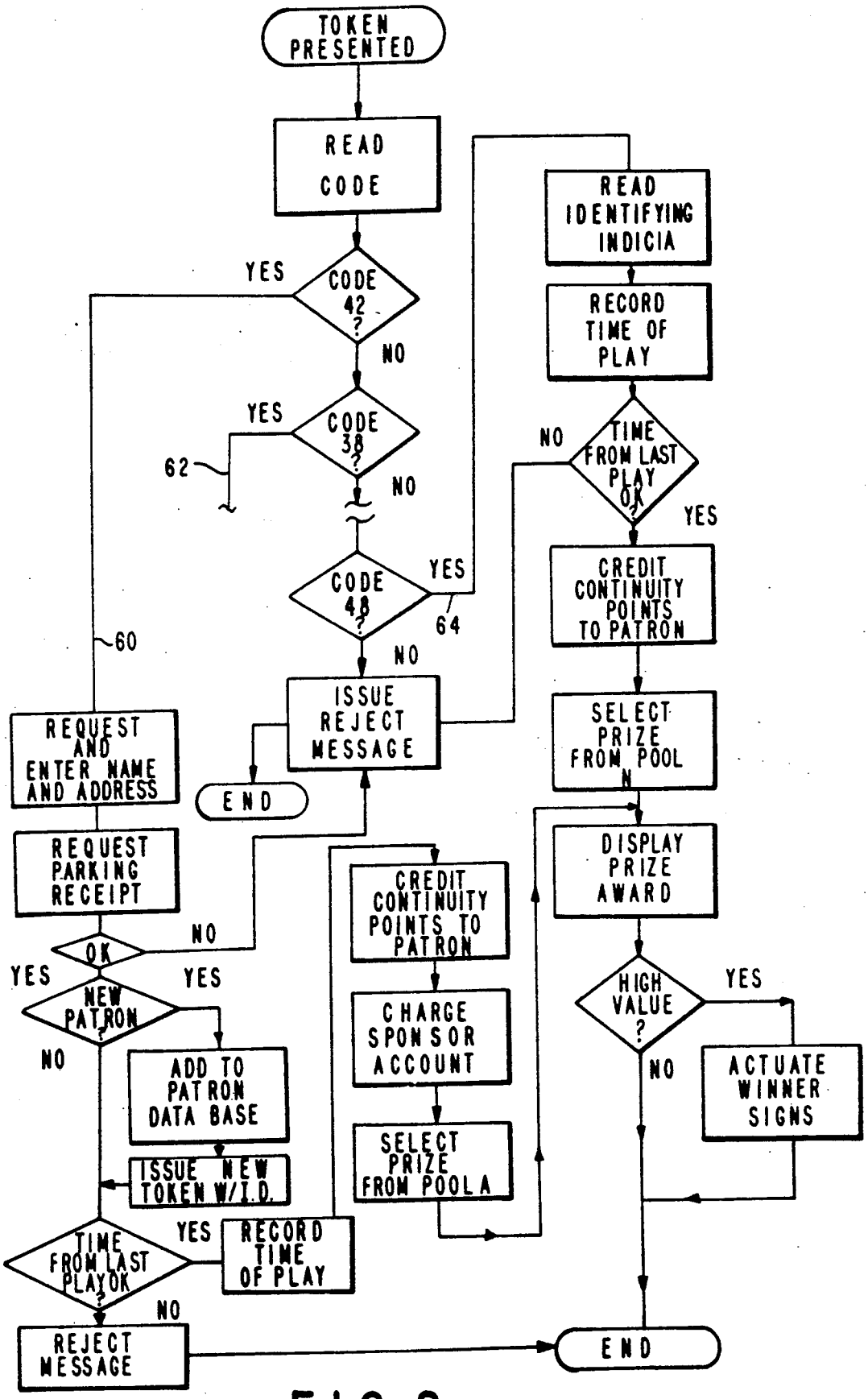
FIG. 2 is a flow chart depicting certain steps in operations according to the method of FIG. 1.

To play the game, the prospective patron must visit one of the redemption locations 12 within the establishment or casino 10. When the patron presents a token, the data processing apparatus including apparatus 14 at the redemption location 12 executes a program as schematically shown in FIG. 2. As a first step, the apparatus automatically reads the machine readable gaming code on the token and tests for the presence of predetermined winning codes. Each of codes 38, 42, 44 and 48 is a winning code. Each winning code is associating with a separate prize pool. If the token presented does not bear any of the winning codes, the data processing equipment issues a reject message though the input/output devices such as through a screen and the routine ends. If the data processing equipment recognizes one of the winning codes, the program branches to a branch associated with that particular gaming code. Thus, if the token presented is a token of the second type, bearing code 42, the data processing equipment will follow program branch 60. If the token bears code 38, the program will follow branch 62, if the token bears gaming code 48, the program will follow branch 64 and so on.

Assuming that the token presented is a token 32 of the second type, bearing code 42, the data processing apparatus following branch 60 will display a message requesting entry of the patron's name, address and other identifying data. The apparatus then requests presentation of an additional qualifying item which in this case is a parking receipt. This additional qualifying item may be selected to target the game, or a portion of the game, to only a select audience. For example, in the case of a casino, the casino may wish to attract patrons who drive their own automobiles, rather than patrons who arrive by bus or other public transportation. Upon presentation of the proper parking receipt, an employee of the casino enters an appropriate entry into data processing equipment 14. The program then tests to see that the name and address have been entered and that the appropriate code has also been entered to indicate that a proper parking receipt was presented. If not, the apparatus issues a reject message and the program ends. If the proper entries have been made for name and address and for a proper parking receipt, the data processing apparatus tests to determine whether the patron presenting the token is a new patron or a patron already known to the establishment.

This is performed by comparing the patron's name and address, or other identifying information entered with patron records stored in central records 24 associated with the central data processing unit 22. If the patron is a new patron, his identity, including his name and address are added to the patron database stored in records 24. Further, the printing apparatus associated with data processing equipment 14 at the redemption location 12 is actuated to prepare a new token 36 of the fourth type, bearing gaming code 48 and also bearing the patron's identity 50 in machine readable form. If the patron is not a new patron, no new token 36 is issued.

The data processing apparatus then tests the time of day against the time at which the same patron last presented a token. This time is shown in the records associated with the patron, as stored in central records 24. Of course, if the patron is a new patron there will be no previous play time recorded. The time from the last play is tested against a predetermined criteria for patrons presenting a token of type 32. For example, the time test may be set to allow each patron to present one token of type 32 every 24 hours, once a week or the like. If the time from the last play for that patron is not sufficient, the data processing apparatus issues a reject message and the program ends. If the time is sufficient, then the patron has qualified to play, both by presentation of the token bearing the correct code 42 and by meeting the other qualifications (supplying his name and address, supplying a parking receipt and having waited a sufficient time from his play). At this point, the data processing apparatus records the time of play for that particular patron in central records 42 and also credits an account associated with that patron with points for continuity of play. The number of points credited to each patron for each play may be determined by any desired predetermined formula which the establishment believes will encourage patronage. For example, the patron may be credited with a fixed number of continuity of play points for each play, or with progressively increasing numbers of points on second and subsequent plays. Points may also be deducted automatically from a patron's account if no plays are made in some specified time, so that only those patrons who play regularly will accumulate substantial numbers of continuity points in their individual accounts. These accounts may be used to determine which patrons play frequently and hence which patrons are good customers of the establishment, and also to reward such good customers, as by giving free gifts when the number of points in a patron's account reaches some predetermined total.

In the next operation along this branch of the program, the data processing apparatus charges the account of a sponsor associated with code 42. In the case of a token 32 distributed as part of a package 40, the sponsor typically will be the manufacturer or distributor of the goods in package 40. By automatically recording the number of tokens bearing code 42 which are presented and charging the sponsor's account for each such presentation, this system can charge the sponsor in an amount proportional to the results achieved, i.e., in an amount proportional to the number of film packages 40 which the sponsor has sold to persons participating in the game. At this point, the data processing apparatus randomly selects a prize from a prize list or pool, denominated pool A. This selection process can be performed by generating a random number through standard random number generation techniques used in data processing and then comparing that random number with preset ranges, each associated with a particular prize. As will be appreciated, the prize to be awarded to any particular patron presenting a token bearing code 42 is determined solely by the randomization process and by the preset ranges associated with prize pool A. The prize to be awarded to that particular patron is determined only after the patron has presented the token. The prize awarded is then displayed by data processing apparatus 14. Although the foregoing steps are complex in description, the same are accomplished substantially immediately upon presentation of the token and other required qualifying items by the patron. Thus, the patron receives substantially instant gratification in the nature of knowing any prize which has he won. The data processing apparatus is also arranged to test the prize awarded against some predetermined criteria of value and, if the value exceeds that predetermined criteria, to actuate indicator 18 and thus make other patrons aware that an individual has won a high valued prize. By activating indicator 18, the system adds to the air of excitement and reinforces the desire of other players present within the establishment to play.

The method steps are substantially similar when other tokens such as tokens 30 of the first class or tokens 34 of the third class are presented, and hence program branch 62 associated with code 38 and hence associated with tokens 30 of the first class is substantially similar to program branch 60, and the other program branch (not shown) associated with tokens 34 of the third class may be substantially similar as well. However, each of these program branches, intensely treatment associated with different tokens, may be varied as desired to omit or add steps, and to change conditions. For example, the qualifiers may be varied along the different program branches so that patrons presenting the tokens of the first type may be required to present a bus ticket rather than a parking receipt, and the prize pool used with these patrons may be somewhat less favorable. For example, along program branch 62 the prizes which may be won, or the probability of winning a high value prize, may be different from along program branch 60. Likewise, the step of issuing a new token 36 may be omitted from some of these program branches. If the establishment is not interested in adding new patrons to its database, the step of requiring name and address or other identifying data, and the steps of adding the patrons to a particular database may be omitted, as may be the step of checking the time from the last play for a particular patron. In this case, patrons may play as many times as they present the appropriate tokens. Typically, with tokens such as tokens 30, 32 and 34, the token is taken by the establishment and kept upon presentation, so that the token can be presented only once. Where the token is not associated with goods, such as tokens 30 and 34, distributed by the establishment itself, there is no need to charge a sponsor account.

Tokens 36 are intended to be permanently or semi-permanently possessed by the patron. As discussed above, the same may be awarded upon presentation of a temporary token such as tokens 30, 32 or 34. The program branch 64 used with such a permanent token 36 is similar to program branch 60, except that the indicia 50 identifying the individual patron are read by the apparatus rather than requesting and entering the name and address of the patron. Also, as depicted, the program branch 64 does not require the patron to present a parking receipt or other qualifying item apart from the token 36 itself. Inasmuch as the data processing apparatus has automatically read the patron identifying indicia 50, the program branch 64 can include crediting of continuity points to the patron and a test for time from the same patron's last play. Here again, if the patron qualifies, as by having an acceptable time from last play, the prize for the patron is selected from a prize pool by an automatic randomization process. Desirably, the automatic randomization process may be adjusted in accordance with continuity credits in the patron's account. For example, where the patron has accumulated a large number of continuity points, the ranges of random numbers associated with high value prizes may be automatically expanded so as to give the patron a greater chance of winning a high value prize. This creates a powerful incentive to the patron to remain within the establishment and continue to play the game. As will be appreciated, while the patron is in the establishment, he normally will utilize other services and/or make other purchases, so that the establishment profits more the longer the patron remains in the establishment.

Games in accordance with the present invention may be varied in almost innumerable ways. One very significant advantage of games in accordance with the invention is that the game can be varied simply by reprogramming the data processing apparatus. In particular, the game can be converted instantaneously to operate with different tokens simply by reprogramming the codes in the data processing apparatus. Where the newly programmed codes match universal product codes or other standard product identifying codes on packaged goods, the game can be revised to establish a marketing tie-in with a new sponsor almost immediately. Thus, in the game as described above, purchase of a package 40 of film provides the consumer with a token 32 bearing the proper winning code 42 to enter the game. However, the establishment can reprogram the computer to accommodate the universal product codes 70 on packages of beer 72 (FIG. 1) or any other package goods. The game can thus be revised almost instantaneously to establish a new marketing strategy in which the establishment works with a different supplier of packaged goods. To establish such a new marketing strategy, there is no need to distribute specially marked packages or other special tokens. Likewise, there is no need to dispose of obsolete packages bearing offers or codes which are no longer valid. The cost of printing special packages is entirely obviated. If desired, any or all of the token types discussed above can be eliminated. In its simplest form, the game can be played using only a single type of token.

In another, particularly useful variant of the game, the reading and prize awarding steps can be performed in the same establishment where packaged goods incorporating the tokens are sold. Thus, the data processing equipment 12 may be located within a store where packages 40 bearing tokens 32 are sold. Thus, a patron may purchase a package incorporating a token and play the game immediately upon such purchase. In a particularly preferred arrangement, the data processing equipment 12 used to read the codes on the tokens and award the prizes may be the same data processing equipment as employed in consummating the sale transaction. Thus, where the goods are sold using an automatic cash register or similar equipment, which reads a product identification code on a product package in the course of making the sale, and where a token is a part of a package bearing the product identification code, the same reading step may be employed both as part of the sale transaction and as the token code reading step of the game. Stated another way, the patron gains a chance to win a prize when the automatic cash register at the point of sale record the patrons' purchase of the particular goods bearing the correct product identification code. Games of this nature may be employed usefully in retail establishments such as supermarkets, toy stores and the like. Here again, the ability to charge back to a sponsor, such as the manufacturer or distributor of the goods bearing the particular identification codes, the absence of any need for special goods packages or other specially distributed tokens and the ability to change promotions at will provides a uniquely effective marketing tool.

As will be appreciated, laws bearing on gambling and the lotteries limit certain types of promotions involving an element of chance, particularly where purchase of goods or services is required as a precondition for entry into the game. Games according the present invention can be, and are intended to be, operated in conformity with the applicable laws. Such laws ordinarily require that the patron or prospective patron be allowed to enter any game of chance without purchasing anything or paying money to acquire an entry. Ordinarily, such laws are satisfied if the patron has the opportunity to acquire a game token without a purchase. For example, where portions of goods packages bearing product identification codes are employed as gaming tokens, the patron or prospective patron may be afforded an opportunity to acquire gaming tokens bearing the same codes by some method which does not involve purchase, as by writing a letter to the sponsor of the game requesting same.

As will appreciated, numerous variations and combinations of the features described above can be utilized without departing from the present invention as defined by the claims. Accordingly, the foregoing description of the preferred embodiment should be taken by way of illustration rather than by way of limitation of the invention as defined in the claims.

What is claimed is:

1. A promotional gaming method comprising the steps of:

(a) distributing tokens to patrons;

(b) automatically reading a code on each of said tokens at a redemption location within an establishment upon presentation of said tokens by patrons and automatically comparing the code on each presented token with one or more predetermined winning codes;

(c) awarding prizes to at least some of the patrons who present tokens bearing said code matching said one or more predetermined winning codes; said tokens including a multiplicity of tokens bearing a common machine readable code which common code matches said one or more predetermined winning codes, said step of awarding prizes including the step of randomly assigning prizes to patrons who present tokens bearing said common code, said step of randomly assigning said prizes being performed upon presentation of said tokens, said step of randomly assigning said prizes including the step of actuating a random selection process in response to presentation of a token bearing said common code.

2. A method as claimed in claim 1, wherein said step of randomly assigning prizes is performed so as to award prizes of different values to different ones of the patrons who present a token bearing said common code.

3. A method as claimed in claim 1, wherein said tokens include a plurality of classes of tokens, each such class including a multiplicity of tokens bearing one of a plurality of common codes, the common code for at lest one of said classes being different from the common code for other ones of said classes.

4. A method as claimed in claim 3, wherein there are a plurality of winning codes such that each common code for each of said plural classes of tokens matches one of said winning codes.

5. A method as claimed in claim 1, wherein said tokens include tokens which are parts of packages of goods, said step of distributing said tokens including the step of selling said packages of goods to patrons.

6. A method as claimed in claim 5, wherein said steps of automatically reading codes on said tokens and awarding prizes are performed concomitantly with the sale of the packages of goods to patrons.

7. A method as claimed in claim 6, wherein said step of automatically reading said codes is performed by automatic data processing equipment and the same automatic data processing equipment is employed to complete sale transactions by which patrons purchase said packages of goods.

8. A method as claimed in claim 5, wherein said codes on said tokens which are part of packages of goods are machine readable product identification codes.

9. A method as claimed in claim 8, wherein each said token is a universal product code symbol.

10. A method as claimed in claim 5 wherein all of said tokens are parts of packages of goods.

11. A method as claimed in claim 5 wherein all of said packages of goods are substantially identical to one another.

12. A method as claimed in claim 1, wherein said step of awarding prizes is performed substantially immediately upon presentation of the token.

13. A method as claimed in claim 1, wherein said step of awarding prizes includes the step of awarding prizes only to those patrons who meet one or more predetermined additional qualifications.

14. A method as claimed in claim 1, wherein said step of automatically reading said code and awarding said prizes is performed by data processing apparatus at said redemption location, the method further comprising the step of testing for said additional qualifications using said data processing apparatus.

15. A method as claimed in claim 13, wherein said additional qualifications include presentation of data identifying the patron, the method further comprising the step of recording the identities of qualifying patrons.

16. A method as claimed in claim 15, wherein said additional qualifications include time since last play by the same patron, the method further comprising the step of recording times of presentations by particular patrons.

17. A method as claimed in claim 2, further comprising the step of recording times of play by individual patrons.

18. A method as claimed in claim 2, wherein at least some of said tokens are unique tokens, each said unique token bearing an identifying indicia identifying a particular patron.

19. A method as claimed in claim 18, further comprising the step of automatically recording times of presentation of a unique token assigned to a particular patron by automatically reading the identifying indicia thereon.

20. A method as claimed in claim 19, further comprising the step of awarding items of value to particular patrons based on the frequency of presentation of that patron's token.

21. A method as claimed in claim 1 wherein said step of distributing tokens to patrons includes the step of distributing said tokens to prospective patrons of said establishment at locations outside of the establishment.

* * * * *

UNITED STATES PATENT AND TRADEMARK OFFICE

CERTIFICATE OF CORRECTION

PATENT NO. : 5,080,364

DATED : January 14, 1992

INVENTOR(S) : Charles B. Seidman

It is certified that error appears in the above-identified patent and that said Letters Patent is hereby corrected as shown below:

Column 1, line 1, "5,007,64" should read -- 5,007,641 --.
Column 1, line 58, "mechanism or" should -- mechanism for --.
Column 2, line 48, "With" should read -- with --
Column 10, line 10, "lest" should read -- least --.
Column 10, line 49, "claim 1" should read -- claim 13 --.
Column 10, line 64, "claim 2" should read -- claim 1 --.
Column 10, line 67, "claim 2" should read -- claim 1 --.

Signed and Sealed this

Twentieth Day of April, 1993

*Attest:*

MICHAEL K. KIRK

*Attesting Officer*

*Acting Commissioner of Patents and Trademarks*